US009169706B2

(12) United States Patent
Kellam, III

(10) Patent No.: US 9,169,706 B2
(45) Date of Patent: Oct. 27, 2015

(54) DRILL-SITE PROPPANT VACUUM SYSTEM

(71) Applicant: Belo Kellam, III, Canto, OH (US)

(72) Inventor: Belo Kellam, III, Canto, OH (US)

( * ) Notice: Subject to any disclaimer, the term of this patent is extended or adjusted under 35 U.S.C. 154(b) by 109 days.

(21) Appl. No.: 13/842,142

(22) Filed: Mar. 15, 2013

(65) Prior Publication Data

US 2013/0312951 A1 Nov. 28, 2013

Related U.S. Application Data

(60) Provisional application No. 61/648,775, filed on May 18, 2012.

(51) Int. Cl.
*E21B 27/00* (2006.01)
*E21B 43/267* (2006.01)

(52) U.S. Cl.
CPC ..... *E21B 27/00* (2013.01); *E21B 43/267* (2013.01)

(58) Field of Classification Search
CPC ..... E21B 27/00; E21B 41/005
USPC ..... 141/1, 11
See application file for complete search history.

(56) References Cited

U.S. PATENT DOCUMENTS

| | | | | |
|---|---|---|---|---|
| 8,562,720 | B2 * | 10/2013 | Stutzman et al. | 95/272 |
| 2011/0162838 | A1 * | 7/2011 | Mackenzie et al. | 166/267 |
| 2013/0233439 | A1 * | 9/2013 | Stutzman et al. | 141/11 |

* cited by examiner

*Primary Examiner* — William P Neuder
(74) *Attorney, Agent, or Firm* — Bracewell & Giuliani LLP; Albert B. Kimball; Taylor P. Evans

(57) ABSTRACT

A proppant collection system for a hydraulic fracturing well site, the well site having one or more proppant handling apparatuses and a closed proppant storage device. The system includes a dust capture system having a hatch in the one or more proppant storage devices, a dust collection cap on the hatch, and a conduit attached to each dust collection cap for receiving dust that enters the dust collection cap from the proppant storage device through the hatch. A central vacuum unit is attached to the conduits of the dust capture system, the central vacuum unit including a slurry tank for receiving dust that is collected by the dust capture system. The slurry tank is adapted to aggregate the dust collected from the proppant storage device.

17 Claims, 4 Drawing Sheets

DRILL-SITE PROPPANT VACUUM SYSTEM

CROSS REVERENCE TO RELATED APPLICATIONS

This application claims priority to and the benefit of U.S. Provisional Application Ser. No. 61/648,775, which was filed May 18, 2012, the full disclosure of which is hereby incorporated herein by reference.

BACKGROUND OF THE INVENTION

1. Field of the Invention

The present invention relates in general to well site safety and maintenance systems and, in particular, to a system and method to contain proppant spillage during drilling and fracturing operations at a well site.

2. Description of the Related Art

Hydraulic fracturing has been used for decades to stimulate production from conventional oil and gas wells. The practice consists of pumping fluid into a wellbore at high pressure. Inside the wellbore, the fluid is forced into the formation being produced. When the fluid enters the formation, it fractures, or creates fissures, in the formation. Water, as well as other fluids, and some solid proppants, are then pumped into the fissures to stimulate the release of oil and gas from the formation.

The proppants used in hydraulic fracturing operations are typically stored in sand bins, or other proppant storage devices. As the proppant is deposited in the sand bins, or as it exits the sand bins, a large amount of dust may be propagated, which will accumulate within the sand bin. This dust can create dangerous conditions. For example, in open sand bins, the dust may leave the sand bin and spread to surrounding areas, causing health hazards to people in the vicinity of the fracturing operation.

In addition, the proppant exits the sand bins onto conveyor belts that carry the proppant on to a blender, which incorporates the proppant into the fracturing fluid to be pumped into the well. During the course of depositing the proppant onto the conveyors, and conveying the proppant to the blenders, some of the proppant may be spilled onto the ground around the machinery. Such a waste of proppant can be costly.

SUMMARY OF THE INVENTION

The present technology provides a proppant technology that overcomes the disadvantages of the prior art by providing a vacuum system that collects proppant that spills off a conveyor, and that removes dust from the inside of a proppant storage device.

In one embodiment, the technology includes a proppant collection system for a hydraulic fracturing well site having a dust capture system. The dust capture system includes a closed proppant storage device with hatches in the top thereof. The dust collection system further includes dust collection caps on the hatches, and a conduit attached to each dust collection cap for receiving dust that enters the dust collection cap from the proppant storage device through the hatch.

A central vacuum unit is attached to the conduits of the dust capture system. The central vacuum unit has a suction line attached to each conduit, and includes a slurry tank for receiving dust that is collected by the dust capture system. The pressure inside the central vacuum unit is lower than the pressure inside the proppant storage device, so that dust generated within the proppant storage device will be drawn of through the dust collection cap and conduit, and into the central vacuum unit. The dust collection cap may also be open to the ambient environment at an upper end thereof so that ambient air can flow into the proppant storage device through the dust collection cap. A weather barrier may be attached to the dust collection cap adjacent the opening. The weather barrier is adapted to allow ambient air to enter the proppant storage device, while simultaneously blocking other environmental elements, such as, for example, rain, from entering the proppant storage device.

Another embodiment of the present technology includes a moveable suction hose for collecting proppant that spills off, or is deposited adjacent to, proppant handling apparatuses, such as conveyors. A central vacuum unit is attached to the moveable suction hose and is adapted to generate pressures below an ambient air pressure. The central vacuum unit includes a slurry tank for receiving proppant that is collected by the moveable suction hose. The slurry tank has an outlet and is adapted to aggregate the proppant collected by the moveable suction hose, and to reintroduce the proppant to the proppant handling apparatuses.

The central vacuum unit may further includes a filter positioned within the central vacuum unit to intersect the proppant received from the moveable suction hose before the proppant enters the slurry tank, and to separate the proppant from other material that may be drawn through the moveable suction hose. In addition, protective sheeting may be placed around the proppant handling apparatuses to create a barrier between the spilled proppant and underlying earth surface. Such a barrier decreases the amount of non-proppant material pulled into the slurry tank by the moveable suction hose.

Some embodiments of the present technology include both a suction hose for collecting spilled proppant, and a dust collection system. In such embodiments, a vacuum system may be connected to both the hose and the dust collection system, and is adapted to generate pressures below an ambient air pressure at the well site, as well as pressures within the proppant storage devices.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning well drilling, running operations, general hydraulic fracturing processes and the like have been omitted inasmuch as such details are not considered necessary to obtain a complete understanding of the present invention, and are considered to be within the skills of persons skilled in the relevant art.

Figure 1:
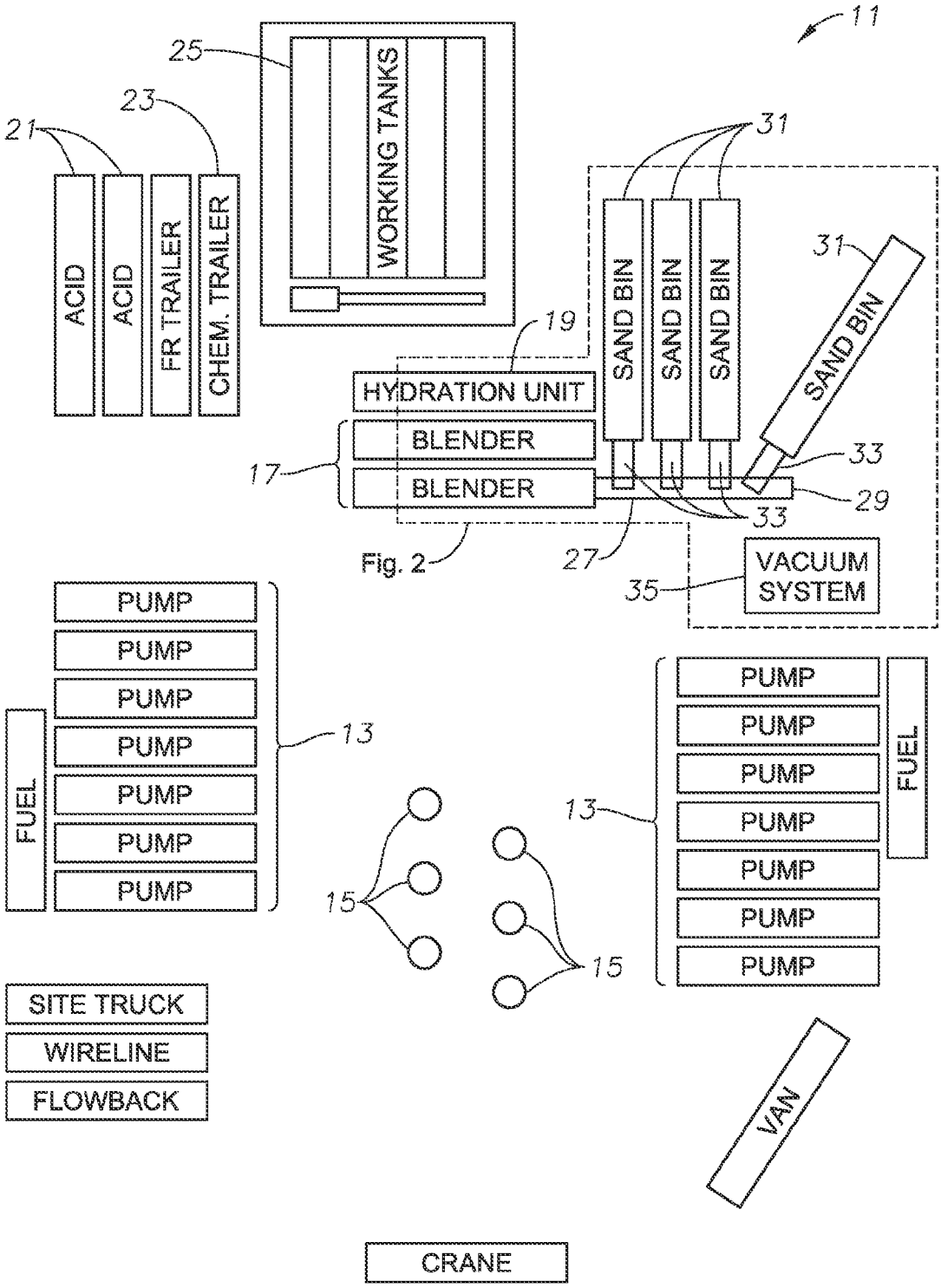
FIG. 1 is a schematic plan view of a well site where hydraulic fracturing is being used to induce production in accordance with an embodiment.

Referring to FIG. 1, an example of a well site 11 for the production of oil and gas is shown. As shown, a process known as hydraulic fracturing is being used to induce the flow of desired substances, such as oil and gas into a previously drilled and cased wellbore. In the illustrated embodiment, a plurality of pumps 13 pump fluid into a plurality of wells 15 along with a mixture of proppant, such as sand, and other substances, such as acids and other chemicals. The substances are used to fracture openings within a formation in a production zone. Particulate matter in the proppant is forced into the fractures to hold open the fractures for production fluids to flow around the proppants into wells 15. Generally, pumps 13 are connected to wells and a plurality of blenders 17 via a manifold (not shown) and flow lines (not shown) that permit pumps 13 to draw fluid blended with proppant and other chemicals for pressurization of the fluid and pumping of the fluid into wells 15. Blenders 17 may include one or more units adapted to receive a base fluid, proppant, and other substances and mix or blend the materials into a generally uniform mixture for further pumping into wells 15. Each blender may be hydraulically coupled to a hydration unit 19 that is further hydraulically coupled to pumps 13 and wells 15. Hydration unit 19 controls the flow of fluid, such as water or brine, into blenders 17. Hydration unit 19 may be hydraulically fed by acid units 21, chemical trailer 23, and working tanks 25. Acid units 21 supply an acid solution to the fluids pumped into wells 15. Chemical trailer 23 supplies a proprietary mixture of chemicals to the fluids pumped into wells 15 and may serve as the control point for the flow of chemicals into both hydration unit 19 and blenders 17. Working tanks 25 store a base fluid, such as water or brine, into which the acid, chemicals, and proppant are mixed so that the fluid may be readily and easily accessed by hydration unit 19.

Blenders 17 are fed with proppant by a conveyor 27, such as a T-belt conveyor. Conveyor 27 may be any suitable conveyor system capable of carrying or moving proppant from a first location to a second location spaced apart from the first location. In the illustrated embodiment, conveyor 27 may include a plurality of pulleys (not shown) having a continuous loop of material or a belt rotatable about the pulleys. The pulleys may be powered by a motor and drive system that is capable of supplying sufficient power to the pulleys to move the belt forward while the belt is under load or subject to loading perpendicular to the movement of the belt. Conveyor 27 carries proppant, such as sand, deposited at a distal end 29 of conveyor 27 to a hopper or feed point of blender 17 for mixing of the proppant with the fluid. Proppant is carried to distal end 29 of conveyor 27 from a plurality of sand bins 31 on one or more conveyors 33. Conveyors 33 may be belt type conveyors similar to conveyor 27. A person skilled in the art will understand that conveyors 27, 33 may be of different sizes and load capabilities and configured to operate at different speeds. A person skilled in the art will also understand that conveyors 27, 33 may also be any other suitable conveyor system adapted to transport proppant or other particulate material. Sand bins 31 may be any suitable proppant storage device capable of containing proppant for use as part of the hydraulic fracturing process. In the illustrated embodiments, sand bins 31 include hatches 47 (shown in FIG. 2 and described in more detail below) through which proppant may be supplied into sand bins 31. Sand bins 31 may also include an opening in a lower portion through which proppant may be gravity fed or fed through by a motorized device such as an auger or similar device.

Still referring to FIG. 1, a vacuum system 35 may be disposed proximate to T-belt conveyor 27. Vacuum system 35 is adapted to capture proppant that may spill off of conveyors 33 and 27 during transport of proppant into blenders 17 as described in more detail below. Vacuum system 35 may also be pneumatically coupled to sand bins 31 as described in more detail below. Various other equipment may be disposed around well site 11 to provide other necessary operations of the hydraulic fracturing process, for example, by providing control systems for operation of the previously described equipment and the like.

Figure 2:
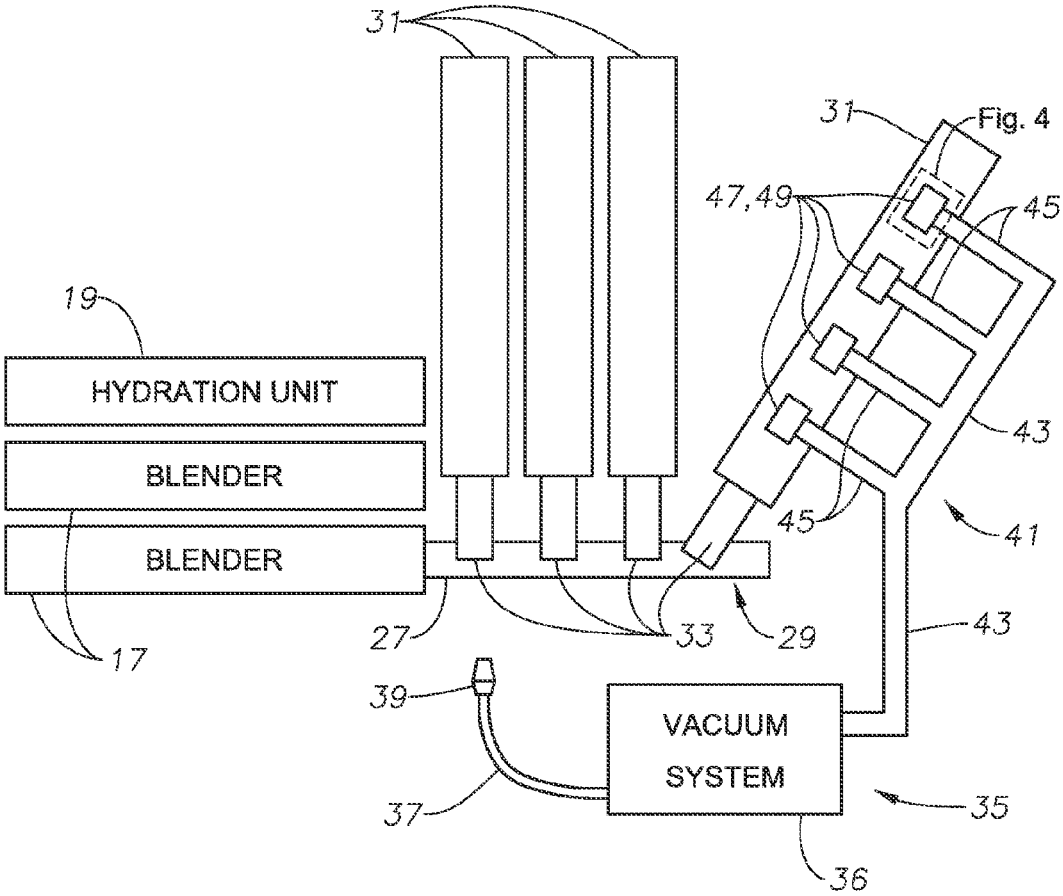
FIG. 2 is a schematic plan view of a sand conveyance system at the well site of FIG. 1 in accordance with an embodiment.

Referring to FIG. 2, vacuum system 35 may include a central unit 36 and a movable suction hose 37 coupled to central unit 36. Central unit 36 may be any suitable industrial portable vacuum system. In the illustrated embodiment, central unit 36 may be an Industrial Vacuum Equipment Corporation Hurricane 500 having a 170 hp diesel or electric powered vacuum. The vacuum may include a positive displacement blower capable of 2,350 CFM at 27" Hg pressure. A person skilled in the art will recognize that other suitable central units 36 may be used, provided the central unit operates generally as described herein. Generally, central unit 36 may include a motor, a centrifugal blower/exhauster or the like, a storage receptacle, a filtration system, and the appropriate interconnections between the components for operation thereof. Central unit 36 may generate pressures lower than the ambient atmospheric pressure of well site 11, i.e. generate suction, so that objects and particulates at well site 11 may be drawn into suction hose 37.

Figure 3:
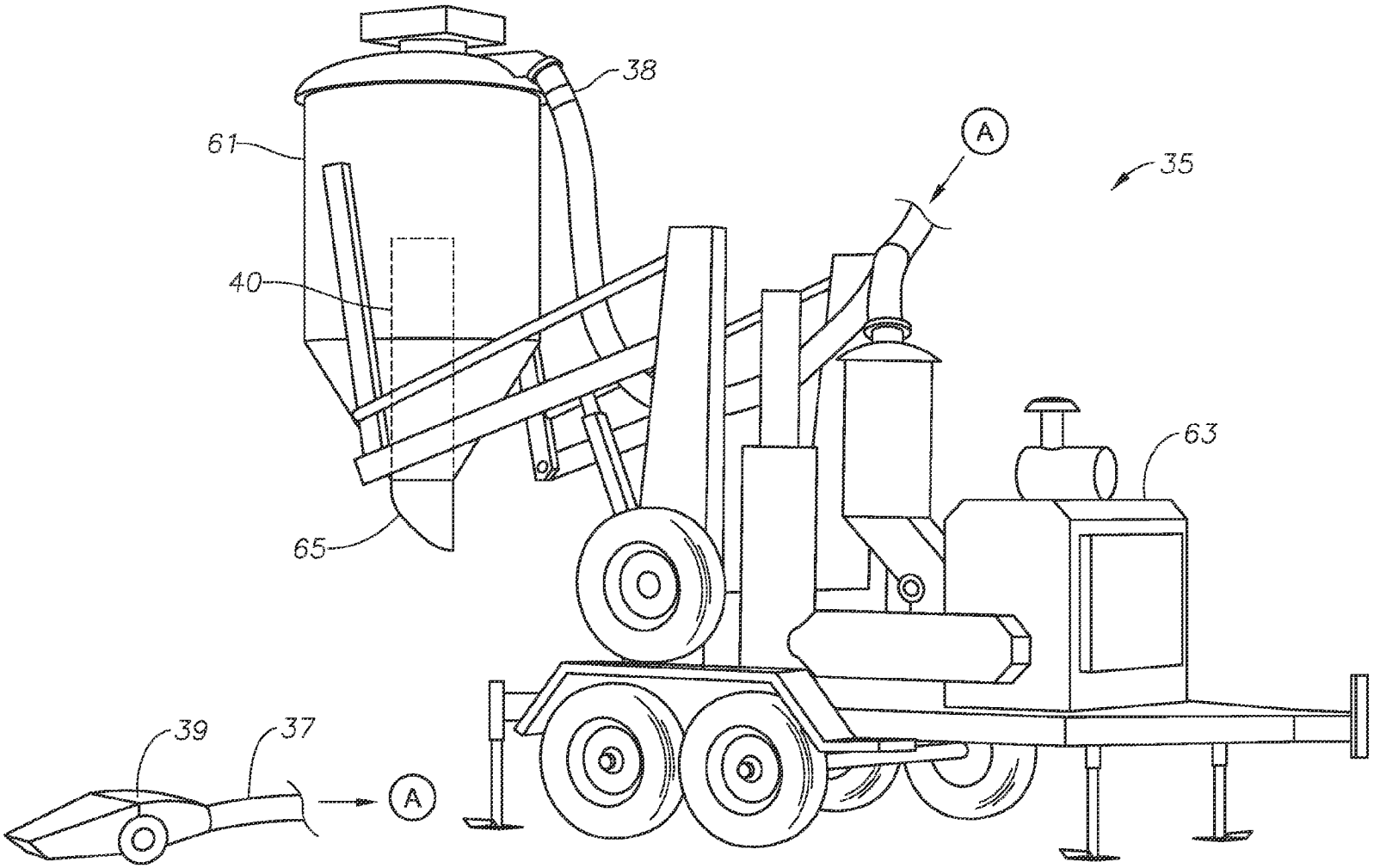
FIG. 3 is a side perspective schematic view of a vacuum system of the hydraulic fracturing well site of FIG. 1 in accordance with an embodiment.

Referring to the example of FIG. 3, vacuum system 35 includes a slurry tank 61 and an engine 63. Hose 37 couples to vacuum system 35 so that hose 37 feeds slurry tank 61 as indicated by notation A. Engine 63 will have sufficient horsepower to generate suction in hose 37 so that proppant spilled off of conveyors 27, 33 may be drawn into a suction nozzle 39 shown mounted on an open end of hose 37. Hose 37 will be sufficiently flexible to allow a user to manipulate suction nozzle 39 proximate to conveyors 27, 33 to draw spilled proppant into hose 37. The collected proppant may be stored in slurry tank 61 and added to the blended materials pumped downhole through outlet 65 of slurry tank 61.

As proppant moves from sand bin 31 to conveyor 33 and from conveyor 33 to conveyor 27, a portion of the proppant may spill off of conveyors 27, 33 and be deposited adjacent conveyors 27, 33. This portion of spilled proppant represents lost material to operators of well site 11, necessitating acquirement of more proppant than may be needed to complete the hydraulic fracturing process. This represents significant extra expense to operators of well site 11. In addition, excess buildup of spilled proppant adjacent conveyors 27, 33 may cause conveyors 27, 33 to bind, or sand-off as the weight of the proppant may halt movement of the pulleys and belt of conveyors 27, 33, halting their operation and causing a halt of the hydraulic fracturing process. Again, this results in a significant cost to the operator of the well site 11. Generally, a laborer may operate vacuum system 35 and manipulate hose 37 so as to draw an end of hose 37 having suction nozzle or scoop 39 adjacent to areas of conveyors 27, 33 where proppant has spilled or fallen off of conveyors 27, 33. The suction generated by central unit 36 will draw the spilled proppant into vacuum system 35, where the proppant may be aggregated and reintroduced into the hydraulic fracturing system at either sand bin 31, conveyors 27, 33, or blenders 17. In this manner, the additional costs due to spillage of proppant are reduced as some or all of the spilled proppant may be collected and used. In an exemplary embodiment, 97% of spilled proppant is collected and reintroduced into the hydraulic fracturing system.

Central unit 36 may also include one or more filter systems 38 adapted to separate proppants from other material that may be drawn through hose 37. The separated proppant may be deposited into slurry tank 61, where a screw type auger 40 may push the proppant through outlet 65. In the illustrated embodiment, outlet 65 deposits the sand onto conveyor 27. A person skilled in the art will understand that the collected proppant may be stored or otherwise reintroduced into the hydraulic fracturing process to reduce loss of proppant. The undesired material collected by vacuum system 35 may be disposed of by any suitable means, for example by spreading the material around the site, or by hauling the material to a landfill or other disposal facility. In an embodiment, plastic sheeting may be placed around sand bins 31, conveyors 27, 33, and blenders 17 as a barrier between spilled proppant and the underlying earth surface at well site 11. In an exemplary embodiment, the plastic sheeting acts as a barrier to prevent inadvertent collection of ambient well site 11 material into vacuum system 35 and the hydraulic fracturing process. In an exemplary embodiment, the plastic sheeting also acts as a barrier to prevent loss of proppant into the ambient well site 11 material and to prevent contamination of well site 11 with non-native materials.

Referring back to FIG. 2, a dust capture system 41 may also be pneumatically coupled to vacuum system 35, and further coupled to sand bin 31. Typically, the sand bin 31 is filled with sand from a truck (not shown) that conveys the sand to the well site. The truck deposits the sand into the sand bin 31 using a hose by spraying the sand into the sand bin 31 through the hose. In some systems, the sand bin 31 may be open. This may lead to problems, however, because the spraying of the sand into the sand bin 31 can generate large amounts of dust, which can billow out of the sand bin 31 into the surrounding environment. This dust presents hazards to the surrounding environment, as well as to people near the site of the fracturing operation. In some embodiments, therefore, the sand bin 31 may be closed, thereby preventing dust from leaving the sand bin 31 and entering the surrounding environment during filling of the sand bin 31.

Dust capture system 41 may include a main line 43 shown having an end connected to an inlet on central unit 36, and four feeder lines 45 that each connect to main line 43. A person skilled in the art will understand that more or fewer feeder hues 45 may be used as needed for the particular application of dust capture system 41 as described in more detail below. Feeder lines 45 communicate with hatches 47 of the sand bin 31 on an upper surface of sand bin 31. The hatches 47 are coupled to dust collection caps 49 adapted to be fit over hatches 47. Feeder lines 45, main line 43, and central unit 36 are thus in communication with a space inside of sand bin 31. In an exemplary embodiment, sand bin 31 has four hatches 47 and four corresponding feeder lines 45. Dust capture system 41 will generate a lower pressure in main line 43 and feeder lines 45 than the pressure in sand bin 31, so that dust generated from movement of proppant within sand bin 31, such as during filling of the sand bin 31, will be drawn off through collection caps 49, feeder lines 45, and main line 43. In one example embodiment, main line 43 and feeder lines 45 may be 2" PVC pipe that is pneumatically coupled to a suction side of central unit 36. A person skilled in the art will understand that main line 43 and feeder lines 45 may be any suitably sized suction lines formed of any suitable material adapted to operate as described above.

In the example of FIG. 2, hatches 47 are formed in upper surfaces of sand bins 31 and permit access to interiors of sand bins 31. Hatches 47 permit an operator or user of sand bin 31 to monitor proppant movement within sand bin 31 during draw off of proppant through the lower portion of sand bin 31. Hatches 47 may also permit an additional opening for sand to be passed into sand bin 31 when sand bin 31 is being filled. Generally, proppant is drawn from sand bin 31 from a lower portion of sand bin 31 through an opening (not shown) in sand bin 31. Proppant will be deposited on an end of conveyor 33 positioned underneath the opening in the lower portion of sand bin 31. Conveyors 33 then operate to carry proppant to conveyor 27. Proppant may be deposited on conveyor 27 at distal end 29 of conveyor 27, or anywhere else along the length of conveyor 27. Conveyor 27 carries the proppant from distal end 29 to blenders 17. Generally, the proppant will be deposited in an upper portion of blender 17, where the proppant is mixed with chemicals, acids, and water for pumping down wells 15. In an example, hatches 47 are opened during this process to maintain an equal pressure between the interior of sand bin 31 and the ambient environment in which sand bin 31 resides. This prevents generation of a pressure differential that may cause catastrophic failure of sand bin 31. While four hatches 47 are shown in the illustrated embodiment, a person skilled in the art will recognize that sand bins 31 may include more or fewer hatches 47.

Figure 4:
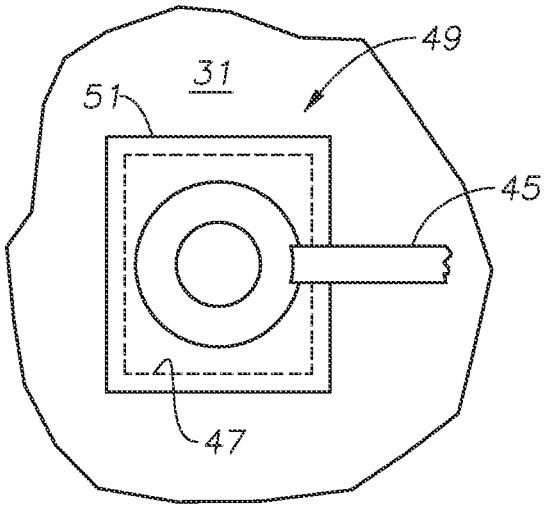
FIG. 4 is a top view of a dust collection cap of the sand conveyance system of FIG. 2 in accordance with an embodiment.
Figure 5:
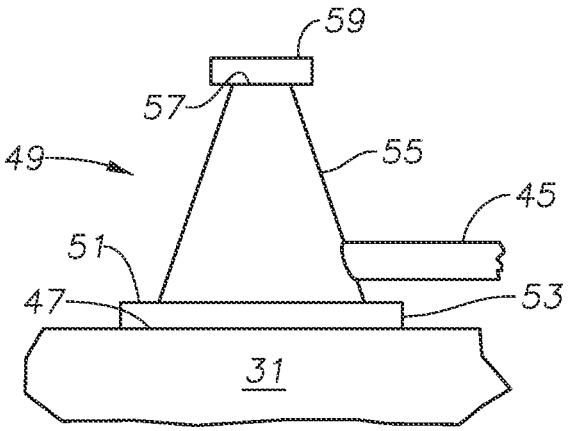
FIG. 5 is a side elevation view of the dust collection cap of the sand conveyance system of FIG. 2 in accordance with an embodiment.

Referring to FIG. 4, hatch 47 may be a square shaped opening in the upper portion of sand bin 31 as shown. A person skilled in the art will understand that hatch 47 may be any suitable opening in the upper portion of an upper deck of sand bin 31. Hatch 47 may include an upwardly extending lip to define a barrier between the upper portion of sand bin 31 and hatch 47. As shown in FIGS. 4 and 5, dust caps 49 include a lower portion 51 adapted to fit over hatch 47. Lower portion 51 may be a substantially planar member having a lip 53 depending normal to lower portion 51. In the illustrated embodiment, lip 53 may fit around the upwardly extending lip of hatch 47 so that lower portion 51 may rest on the upwardly extending lip of hatch 47 having lip 53 surrounding the lip portion of hatch 47. In this manner, dust collection cap 49 may mount over hatch 47. Dust collection cap 49 includes an upwardly extending portion 55. In the illustrated embodiment, upwardly extending portion 55 is a cone shaped member sealingly joined at a wider end to lower portion 51. Upwardly extending portion 55 may have a hollow interior to allow for a flow of matter through upwardly extending portion 55. Feeder line 45 is pneumatically coupled to upwardly extending portion 55 proximate to lower portion 51, and in fluid communication with hatch 47. In an example of operation, vacuum system 35 draws fluid from lines 43, 45 to generate a lower pressure in upwardly extending portion 55 of dust collection cap 49. As proppant is drawn from sand bin 31 to conveyors 27, 33, dust develops within sand bin 31 and billows upward toward hatches 47. The dust enters upwardly extending portion 51 and will be drawn into feeder line 45 to be carried back to vacuum system 35. Upwardly extending portion 55 has an opening 57 at its upper end opposite lower portion 51. Opening 57 permits ambient air to flow into sand bin 31 through dust collection cap 49 to prevent generation of excessive suction in sand bin 31. A weather cap 59 fits over opening 57 to prevent passage of rain or other moisture into dust collection cap 49 and sand bin 31. Weather cap 59 may be raised from or otherwise partially separated from opening 57 to permit air flow around weather cap 59 into opening 57. A person skilled in the art will understand, that dust collection cap 49 may have any other suitable shape, for example, pyramidal, cuboid, spherical, or the like.

A person skilled in the art will understand that by having one or more laborers proximate to the proppant movement apparatus, conveyors 27, 33, the laborers will be suitably placed to conduct sampling operations of the proppant during proppant movement operations. In this manner, a laborer may procure proppant samples from conveyors 27, 33 and test the samples to ensure that the proppant used during that particular stage of the hydraulic fracturing process matches the specifications of the proppant needed for that particular stage of the hydraulic fracturing process.

Accordingly, the disclosed embodiments provide numerous advantages. For example, the disclosed embodiments provide a dust collection system that substantially eliminates waste and decreases loss of proppant that may billow into the atmosphere as dust or spill off of a conveyor during the hydraulic fracturing process. This reduces costs, and operators may eliminate the requirement to purchase excess proppant to accommodate for this spillage and dust loss. In addition, the disclosed embodiments decrease downtime of the system by eliminating sanding off the belt events that cause partial or total shut down of the system while the conveyors are cleaned and brought back online. Still further, the disclosed embodiments increase workplace safety by eliminating sand piles adjacent the conveyors that may trip or otherwise injure workers and eliminate airborne particles that may cause asthma or other lung related ailments in site workers.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A proppant collection system for a hydraulic fracturing well site, the well site having one or more proppant handling apparatuses and a proppant storage device, the collection system comprising:

a dust capture system, comprising:

a hatch in the proppant storage device;

a dust collection cap on the hatch; and a conduit attached to the dust collection cap;

a central vacuum unit having a suction line attached to the conduit; and a slurry tank attached to a discharge of the central vacuum unit, so that when the proppant storage device is being filled and an amount of proppant dust is found in the proppant storage device, substantially all of the dust flows through the conduit and to the slurry tank;

wherein the dust collection cap has a weather barrier attached to the dust collection cap adapted to allow ambient air to enter the proppant storage device, while simultaneously blocking other environmental elements from entering the proppant storage device.

2. The proppant collection system of claim 1, further comprising a main line attached to the central vacuum unit, and wherein the hatch is a plurality of hatches, the dust collection cap is a plurality of dust collection caps, and the conduit attached to each of the dust collection caps is in turn attached to the main line.

3. The proppant collection system of claim 1, wherein the pressure inside the central vacuum unit is lower than the pressure inside the proppant storage device, so that dust generated within the proppant storage devices will be drawn off through the dust collection cap and conduit, and into the central vacuum unit.

4. The proppant collection system of claim 3, wherein the hatch has a hatch lip that extends outwardly from the surface of the proppant storage device, and the dust collection cap has a cap lip that corresponds to the hatch lip when the dust collection cap is positioned over the hatch to help align the dust collection cap relative to the hatch.

5. The proppant collection system of claim 4, wherein the dust collection cap has a hollow body attached to the cap lip, and wherein the hollow body is attached to the conduit.

6. The proppant collection system of claim 5, wherein the hollow body of the dust collection cap is open to the ambient environment at an upper end thereof so that ambient air can flow into the proppant storage device through the dust collection cap.

7. The proppant collection system of claim 1, wherein the hatch is positioned in an upper surface of the proppant storage device so that an operator can monitor proppant movement within the proppant storage device, can gain access to the interior of the proppant storage device, and can add proppant to the proppant storage device through the hatch.

8. The proppant collection system of claim 7, wherein the hatch is open to the ambient environment so that an equal pressure is maintained between the interior of the proppant storage device and the ambient environment.

9. A proppant collection system for a hydraulic fracturing well site, the well site having one or more proppant handling apparatuses and one or more proppant storage devices, the collection system comprising:

a vacuum system adapted to generate pressures below an ambient air pressure at the well site;

a suction hose coupled to the vacuum system and adapted to be manipulated to move an end of the suction hose adjacent the proppant handling apparatuses;

a dust collection system adapted to be pneumatically coupled between the vacuum system and the proppant storage devices, the dust collection system adapted to supply pressure lower than the ambient pressure internal to the storage devices to draw off dust from the storage device; and the suction hose and vacuum system adapted to collect proppant spilled from the proppant handling apparatuses and store and move the collected proppant to the proppant handling apparatuses.

10. The proppant collection system of claim 9, wherein the vacuum system includes a motor, a slurry tank, and a filtration system.

11. The proppant collection system of claim 9, wherein the proppant handling apparatuses include apparatuses selected from the group consisting of sand bins, conveyors, and blenders.

12. The proppant collection system of claim 9, wherein the vacuum system has a filter system adapted to separate proppants from other material that may be drawn through the suction hose.

13. A proppant collection system for a hydraulic fracturing well site, the well site having one or more proppant handling apparatuses, the collection system comprising:

a moveable suction hose for collecting proppant that spills off, or is deposited adjacent to, the proppant handling apparatuses;

a central vacuum unit attached to the moveable suction hose, and adapted to generate pressures below an ambient air pressure, the central vacuum unit including a slurry tank for receiving proppant that is collected by the moveable suction hose;

the slurry tank having an outlet and adapted to aggregate the proppant collected by the moveable suction hose, and to reintroduce the proppant to the proppant handling apparatuses.

14. The proppant collection system of claim 13, wherein the central vacuum unit includes a filter positioned to intersect the proppant received from the moveable suction hose before the proppant enters the slurry tank, and to separate the proppant from other material that may be drawn through the moveable suction hose.

15. The proppant collection system of claim 13, further comprising:

protective sheeting for placement around the proppant handling apparatuses, and that creates a barrier between the spilled proppant and underlying earth surface.

16. The proppant collection system of claim 13, wherein the slurry tank has a screw-type auger adapted to push the aggregated proppant out through the outlet.

17. The proppant collection system of claim 13, wherein proppant collection system collects and reintroduces to the system 97% of the spilled proppant.

* * * * *